United States Patent [19]

Backstein

[11] 4,038,901

[45] Aug. 2, 1977

[54] SUBMERGIBLE DETONATING DEVICE

[75] Inventor: Günter Backstein, Meerbusch, Germany

[73] Assignee: Rheinmetall G.m.b.H., Duesseldorf, Germany

[21] Appl. No.: 690,968

[22] Filed: May 28, 1975

[30] Foreign Application Priority Data

July 10, 1975 Germany ..... 2530707

[51] Int. Cl.[2] ..... F42C 5/00

[52] U.S. Cl. ..... 89/1 B; 102/81; 114/221 A

[58] Field of Search ..... 114/221 A, 20 B; 89/1 B; 102/18 MS, 81, 76 P, 77; 83/639

[56] References Cited

U.S. PATENT DOCUMENTS

| | | | |
|---|---|---|---|
| 2,420,987 | 5/1947 | Temple | 114/221 A |
| 3,020,871 | 2/1962 | Temple | 114/221 A |
| 3,326,172 | 6/1967 | Kish | 114/221 A |
| 3,760,674 | 9/1973 | Temple | 114/221 A X |
| 3,776,165 | 12/1973 | Sabranski et al. | 114/221 A |
| 3,780,689 | 12/1973 | Giebel et al. | 89/1 B X |

*Primary Examiner*—David H. Brown

[57] ABSTRACT

A submergible ignition device for a submarine explosive cable cutter adapted to cut the anchoring chains and steel cables of sea mines by detonating an explosive charge. A detonator is mounted in a housing and detonates an explosive charge when impacted by a spring-biased ignition needle. A driver rod is connected to a cotter safety pin. The driver rod coacts with a shear plate which is punched through by the driver rod when the latter is impacted by a predetermined force. A spring-biased blocking rotor having a built-in detonator is adapted to coact with an ignition needle. The blocking rotor is released by the action of the driver rod. A water pressure safety device also coacts with the blocking rotor and includes a dummy position setting device. All of the safety devices are operatively connected to ensure that said detonator can only be triggered after the safety devices have been positively moved to their unblocking positions.

10 Claims, 10 Drawing Figures

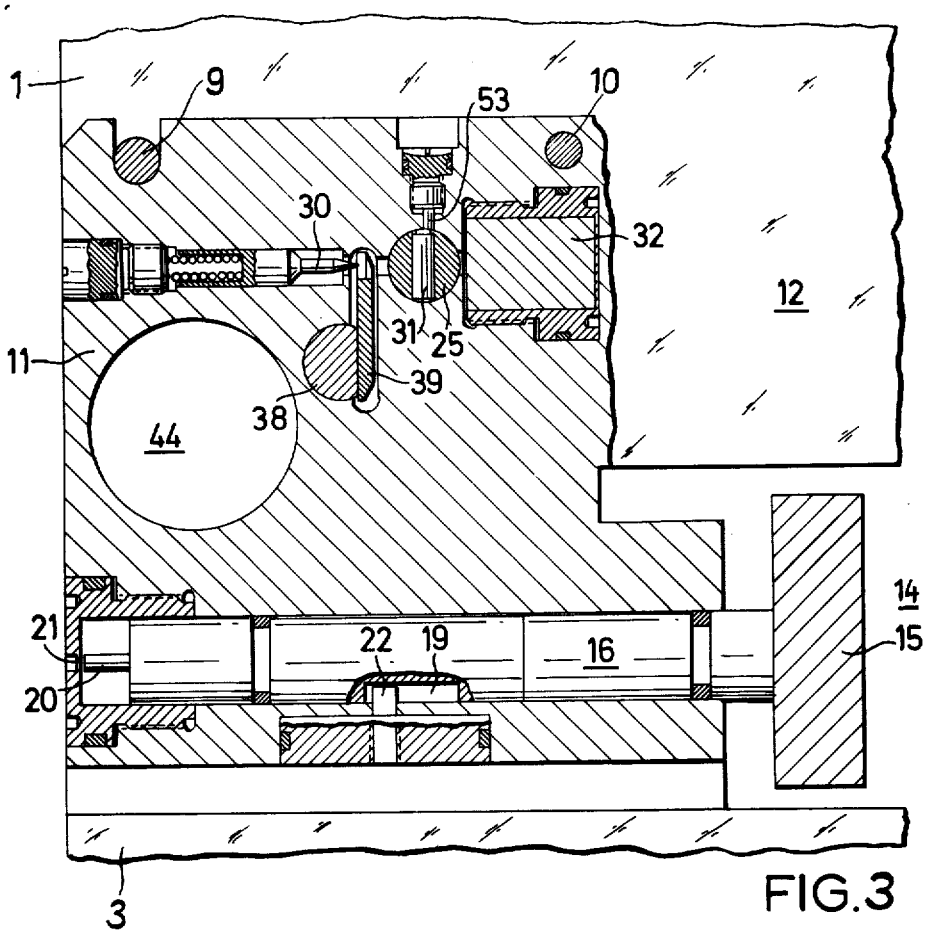
FIG.3
FIG.4
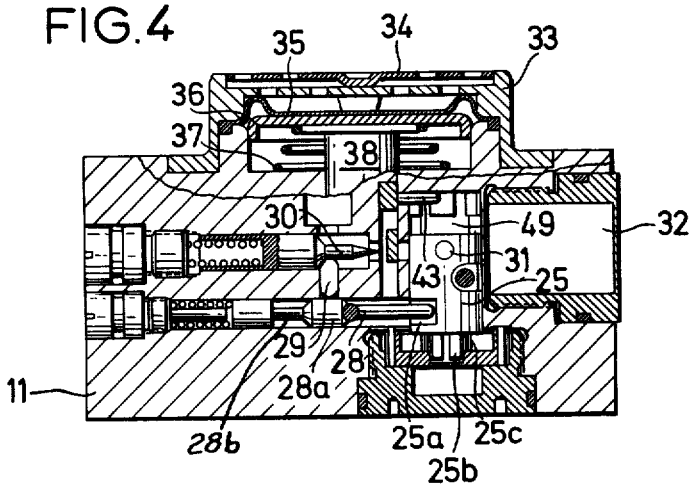

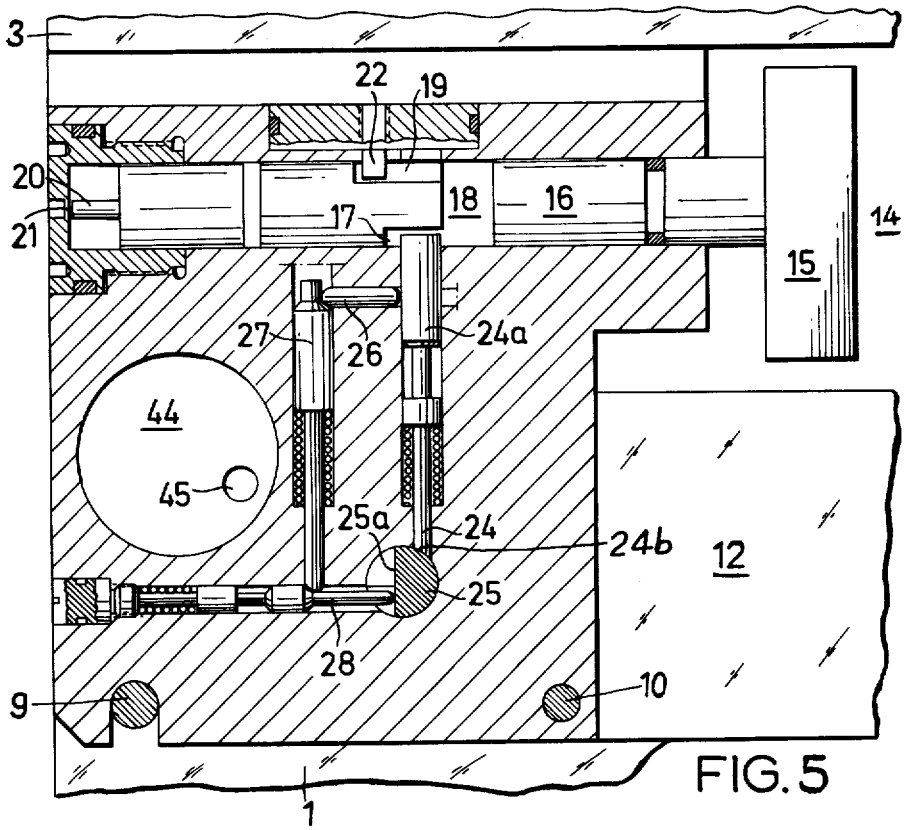
FIG. 5
FIG. 6
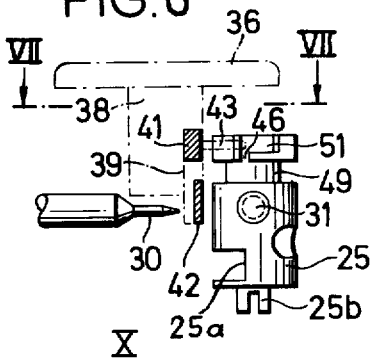
FIG. 8
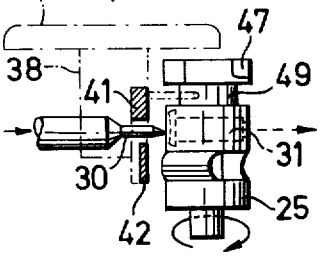
FIG. 10
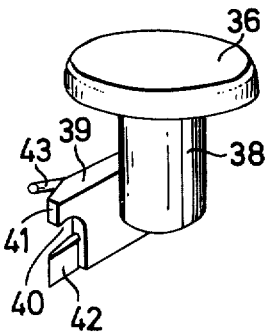
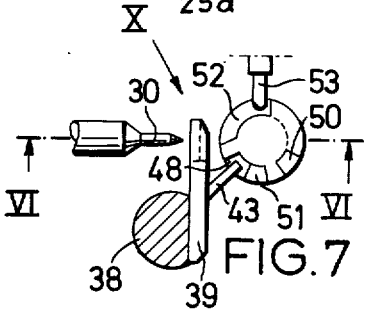
FIG. 7
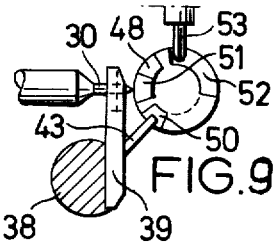
FIG. 9

SUBMERGIBLE DETONATING DEVICE

BACKGROUND OF THE INVENTION

The invention relates to a submergible ignition device for a submarine explosive cable cutter which is towed by a cable under water and serves to cut under water the anchoring chains and steel anchoring cables of sea mines and the like. The device includes a pressure-dependent element which can be activated at the anchor chain. When the pressure dependent element is so activated, the detonator is activated via built-in safety devices as well as via a transfer charge thereby igniting the explosive charge.

The know detonators of this type have the common drawback that, although they have been designed as submarine detonators, they can be detonated above water or only in a slightly submerged condition where no anchoring chains of sea mines can be found. The detonation occurs as soon as a predetermined pressure is exerted on the element which triggers the ignition. Such pressure can occur while the device is on dry land due to an accident or while the device is slightly submerged by means of floating debris, logs or the like, whereby the device explodes which, since it is accidental, may have disastrous consequences.

A further drawback in the detonators of the state of the art resides in that the detonator may reach the desired water depth and may, due to pressure exerted by a foreign object become triggered without detonating because of a malfunctioning of the detonator. Thereafter, the detonator remains in a triggered condition and can, after the towing cable has been retracted, be struck against the wall of the towing vessel and thereby be detonated.

SUMMARY OF THE INVENTION

It is an object of this invention to provide an improved submergible explosive cable cutter device which operates securely and has an effective explosive capability while at the same time having a high degree of security against accidental detonation.

According to this invention the desired object is obtained by providing the detonator with a cotter pin safety device, a shearing force safety device and a water pressure safety device which includes a detonator rotor block, an ignition needle block and a blind or dummy adjusting device. The aforementioned members and elements operate jointly so that the triggering of the detonator can only occur after a positive releasing or unblocking of the aforementioned safety devices.

The shearing force safety device consists of a release plate together with a slideable striker and a ground plate which, when a predetermined pressure applied to the release plate is exeeded, causes the ground plate together with the striker to be punched out. The striker is non-rotatably guided in a longitudinal slit of the detonator housing by means of a pin. This striker has a recess which is engaged by a spring-biased safety bolt after punching or striking of the striker. The safety bolt further, when not actuated, bears against the rotor and thereby forms a detonator-rotor block which is only un-blocked after the safety bolt engages in the recess of the striker.

There is, furthermore, transversely arranged relative to the safety bolt a long locking pin as well as a blocking bolt which extends parallelly to the safety bolt. When the safety bolt engages in the recess of the striker the long locking pin and the blocking bolt are released successively whereby the rotor due to the released force of a spring-biased pressure bolt, is impacted by said last-mentioned bolt which applies a turning torque thereto.

The spring-biased pressure bolt coacts with a short locking pin in such a way that in the end position of the pressure bolt a short locking pin is also released and by means of this release the blocking of the ignition needle is removed.

According to the invention, the water pressure safety device consists of a rubber membrane which is loaded by the water pressure, a spring actuator piston operatively mounted in advance of an air-filled compensating chamber and a blocking slide secured to the piston and having an obliquely projecting pin. The arrangement operates so that when a certain water pressure is reached in accordance with a predetermined submerging depth a reliable ignition needle block as well as a detonator-rotor block is moved into a non-blocking position.

The blocking slider consists for this purpose of a plate secured on one side of a piston shaft. This plate has a transversely extending forward edge with recesses which, according to the penetration depth of the piston, either releases the ignition needle or blocks it.

Furthermore, the obliquely projecting pin, when a predetermined water pressure is reached, is transferred from the first transverse groove of the rotor into a ring groove of the rotor, whereby the rotor can after the release of the rotor block align itself with the detonator in an ignition position.

A blind groove is disposed laterally from the first ring groove, the blind groove retaining the pin when the shear force safety device is deliberately or inadvertantly released before the water pressure safety device.

BRIEF DESCRIPTION OF THE DRAWING

The object and features of the invention may be better understood with reference to the following detailed description of an illustrative embodiment of the invention, taken together with the accompanying drawing in which:

FIG. 3 is a cross-sectional view along line III—III of FIG. 2;

FIG. 4 is a cross-sectional view of the detonator along line IV—IV of FIG. 1;

FIG. 5 is a cross-sectional view of the detonator along line V—V of FIG. 2;

FIGS. 6 - 9 are schematic illustrations of elements of a water pressure safety device built into a detonator wherein the elements of the water pressure safety device are shown in various operative positions; and FIG. 10 is a perspective view of a member of the water pressure safety device wherein the piston and blocking slide is shown in detail.

DESCRIPTION OF THE PREFERRED EMBODIMENT

Figure 1:
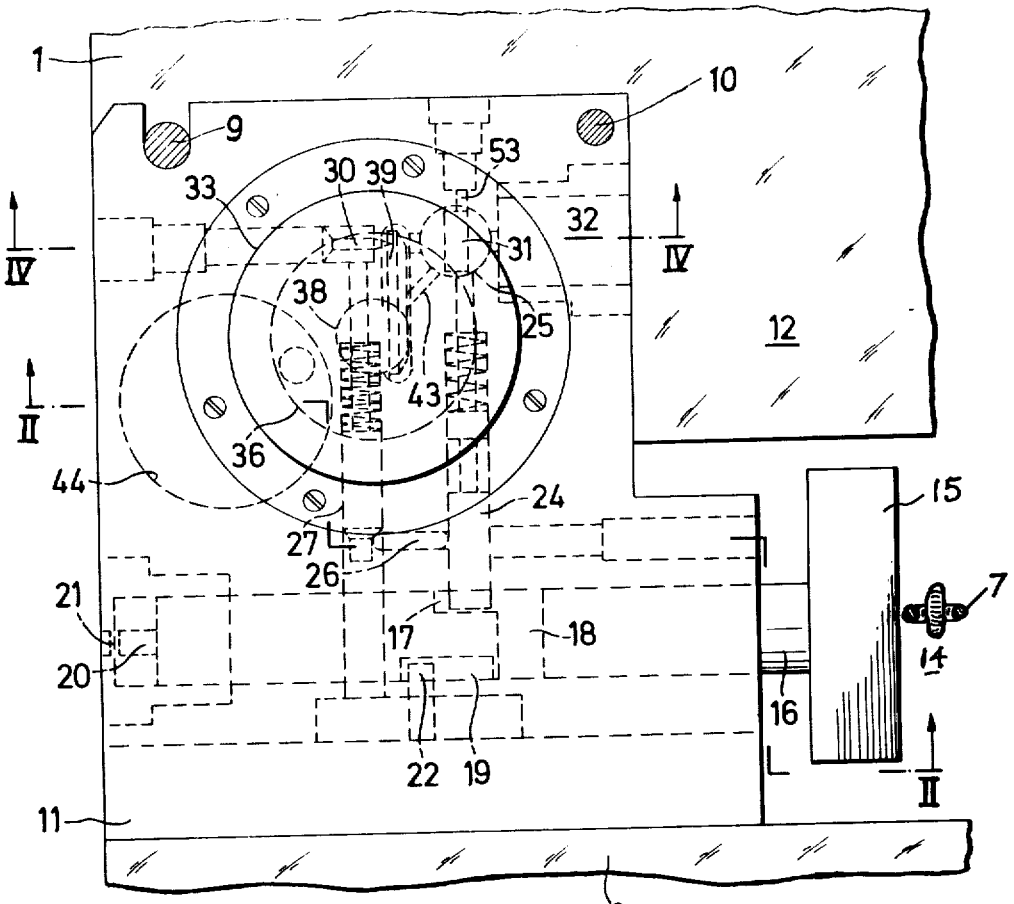
FIG. 1 is a top plan view of the detonator for the explosive cutting device.
Figure 2:
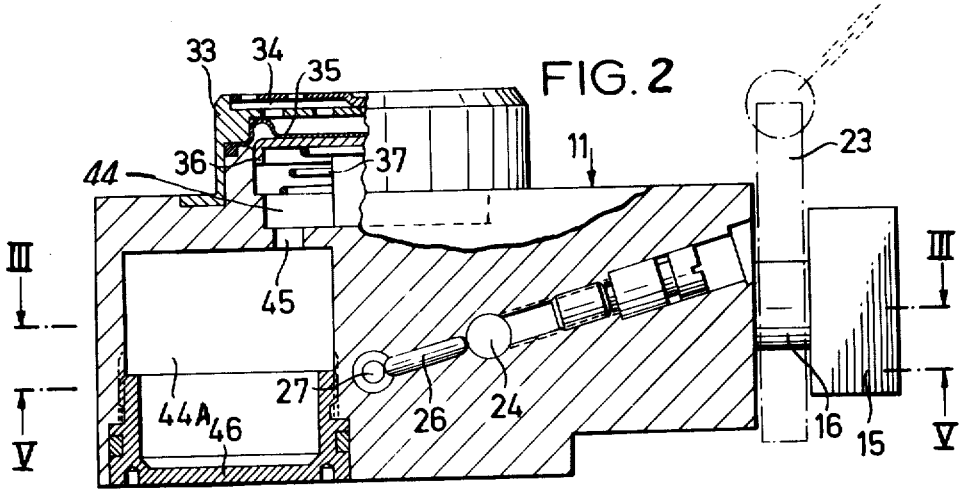
FIG. 2 is a cross-sectional view of the detonator along line II—II of FIG. 1.

Referring now to the drawing the detonator forms a part of a non-illustrated submarine explosive cable cutting device. This detonator is preferably mounted in a housing 11 which in turn is removably connected with the gripper 1 of the cable cutting device via a shear pin 10 and a pivot pin 9. When a very large force is exerted on a release plate 15 by, for example, an anchor chain or a steel cable, the detonator shear safety arrangement 9 and 10 insures that the detonator is separated from the submergible explosive cable cutting device and sinks to the ocean floor.

The gripper mouth 14, and inner limit of which is formed by the release plate 15, is constructed in such a way that, for example, an anchor chain 7 is adapted to run into the gripper mouth. A cotter safety pin 23 is disposed between the detonator housing 11 and the release plate 15. This cotter pin 23 is removed when the detonator is cleared or triggered. The afore-described arrangement constitutes the cotter pin safety device.

The release plate 15 is rigidly mounted on a ram or driver rod 16 which is slideably mounted in a bore of the housing 11. The driver rod 16 has on one side a longitudinal slit-recess 17, 18 and on the other side a longitudinal slit 19 and is provided at its free end with a lug 20.

When an anchor chain presses the release plate 15 with a predetermined force, the lug 20 mounted at the free end of the driver rod 16 contacts a bottom plate 21 and punches therethrough, whereby the release plate 15 with the driver rod 16 is caused to move further into the detonator housing 11. A pin 22 which extends into the longitudinal slit 19 of the driver rod 16 insures that the latter driveably moves into the housing 11 in a non-rotatable manner.

The shear force safety device consists therefor of a bottom plate 21 which is adapted to be punched through by the lug 20 of the driver rod 16. A spring-biased safety bolt 24 extends into the longitudinal slit 17 disposed on the other side of the driver rod 16. When the driver rod 16 has been pushed back as described herein above, then the safety bolt 24 is caused to snap into the recess 18. The safety bolt 24 has an oblique contacting surface 24*b* at its other end which normally bears against the peripheral surface of a rotor 25. When the safety bolt 24 snaps into the longitudinal slit 17, this oblique surface 24*b* releases the rotor 25 (see FIG. 5).

The safety bolt 24 coacts with a transversely positioned locking pin 26, which in turn coacts with a blocking bolt 27 which extends and is movable parallelly relative to the safety bolt 24. The coaction between the transverse locking pin 26 and the blocking bolt 27 is such that when the locking bolt 24 extends into the recess 18 of the driver rod 16 the locking pin 26 projects into the bore for the safety bolt 24 behind a shoulder 24*a* thereof and thereby releases the spring-biased blocking bolt 27 which in turn releases a spring-biased pressure bolt 28. The free forward end of the pressure bolt 28 bears continuously eccentrically against a milled out surface 25*a* of the rotor 25 and, after being released, tends to rotate the rotor 25 90° about its axis. A detonator 31, which is built-in to the rotor 25 (see FIG. 3) is thereby triggered (see FIG. 5).

Independent from the pressure exerted by the pressure bolt 28, the rotor 25 is provided with a coil spring 25*c* which envelopes the axial shaft 25*b* (see FIG. 4) and thereby provides the rotor 25 with a turning torque. The pressure bolt 28 is still shown in a locked position in FIG. 4. When this pressure bolt 28 is released its point enters into a recess 25*a* of the rotor 25 so that a transversely moving locking pin 29 descends behind a collar 28*a* toward the thin shaft portion 28*b* which is disposed perpendicularly to the locking pin 29, thereby also releasing the spring-biased ignition needle 30. This spring-biased ignition needle 30 can now, after all these safety devices have been released, snap forward and strike and thereby ignite the detonator 31, which in turn ignites a transfer charge 32, which in turn ignitably coacts with an explosive charge 12. In addition to the aforedescribed safety devices, the ignition housing 11 has built therein a water pressure safety device and a dummy adjusting arrangement. The ignition devices of the state of the art generally have at least one rammer driver rod which can be supplemented by a water column, so that a triggering of the detonator is conditioned on the fact that the detonator must at least have reached the water.

The detonator of this invention distinguishes itself from the aforedescribed operative principle in that it can be triggered only at the predetermined water depth region, which is that region in which in effect the to be cut anchor chain or steel cables can be found. Furthermore, the dummy adjustment arrangement insures that, when the positive release is not effected, that the shear force safety device is released before the water pressure safety device, thereby causing a block, so that the water pressure safety device can no longer be released.

The water pressure safety arrangement consists, first of all, of a sieve box 33 having therein mounted a sieve plate 34. This sieve box 33 is mounted on the detonator housing 11. There is mounted between the sieve box 33 and the detonator housing 11 a rubber membrane 35 against which there presses the piston 36 which is biased thereagainst by means of coil spring 37. The piston 36 is provided with a strong piston shaft 38, which supports at a flattened side thereof a blocking slider 39. This blocking slider 39 consists of a plate secured to one side of the piston shaft 38. This plate has a forward slanted edge which extends parallelly to the piston shaft axis and extends radially approximately up to the periphery of the piston 36. A recess 40 at the forward edge of the blocking slider 39 (see FIG. 10) forms two teeth at this forward edge, the thicker tooth 41 of which only performs a guiding function and the thinner tooth 42 of which performs an important blocking function which will be explained hereinbelow. Furthermore, there extends obliquely from the blocking slider 39 a pin 43 (see FIG. 10).

The rubber membrane 35 constitutes a seal for a pneumatic compensating chamber 44 which extends through the detonator housing 11. This compensating chamber 44 is situated underneath the piston 36 and is in communication with a secondary compensation chamber 44*a* via a bore 45. This secondary compensation chamber is hermetically sealed by means of a threaded nut 46.

The piston 36 with the blocking slider 39 and its tooth 42 coacts with the ignition needle 30. The pin 43 of the blocking slider 39 coacts with the rotor 25.

The aforedescribed coactions are clearly illustrated in FIGS. 6 - 9. Thus the water pressure safety arrangement is illustrated, for example, in FIGS. 6 and 7 in a non-operative condition, that means that the submarine explosive cutting device is still on land or just slightly submerged. The piston 36 only reaches its lower seating surface in the ignition housing 11 when the submarine explosive cable cutting device has been submerged at least three meters under the water surface. When such a water depth is reached, the water pressure pushes the piston 36, via the sieve box 33, the sieve plate 34 and the rubber membrane 35 to such an extent that the coil spring 37 as well as the air in the compensation chamber 44 are compressed to such an extent that the piston 36 reaches its lower seat surface in the housing 11. This position is illustrated in FIGS. 8 and 9. It can be noted when comparing the positions of the blocking slider 39 in FIGS. 6 and 8 that, in the first position (FIG. 6) the blocking tooth 42 is situated in front of the ignition needle 30, and in the second position (FIG. 8) the ignition needle 30 has passed through the recess 40 and can penetrate into the detonator 31, which has been rotated 90° by the rotor 25, in an unobstructed manner thereby igniting the detonator 31. This ignition is conditioned on the release of the mechanical rotor safety mechanism (the bolt 24) and the ignition needle blocking mechanism (bolt 28, pin 29).

The ignition exlosive beam ignites the transfer charge 32 which in turn detonates the explosive charge 12.

In the unexpected event that the ignition needle 30 does not impinge on the detonator 31 then, on the condition that also the ignition shear pin safety arrangement 9, 10 malfunctions, at a dropping of the water pressure, the obliquely extending pin 43 assumes its original inoperative position by extending through a second transverse recess 50 of the rotor 25. In the last-mentioned position the blocking tooth 42 is slid in front of the ignition needle 30 and thereby blocks the ignition needle path. This blocking of the ignition needle path reliably prevents a subsequent ignition even then when a strong vibration of the detonator occurs, for example, by impacting the cable cutting device on the wall of a ship or causing a similar shock force which releases the ignition needle 30.

If for any reason whatsoever, the shear force safety arrangement is forceably unblocked prior to the unblocking of the water pressure safety arrangement, then the pin 43 moves from the first transverse recess 48 into the adjacent blind recess 51 of the rotor 25 and remains stuck therein because the rotational force of the rotor 25 acts contrary to the blocking action of the pin 43. This characteristic of the rotor 25 is imparted onto it by the spring biased pressure bolt 28 as well as by the action of the coil spring 25c. The aforedescribed position which is assumed by the rotor after it has moved through an angle of 20°, constitutes the dummy position which can not be released by any outside action. Thus, it can be noted that when the bottom plate 21 of the shear force safety device is punched through by the lug 20 of the driver rod 16, due to, for example, a strong blow against the plate 15, the safety bolt 24 and locking pin 29 are released as described hereinabove and the rotor 25 is turned by the action of the coil spring 25c until the pin 43 moves from the first transverse recess 48 into the adjacent blind recess 51. This rotary movement encompasses about 20° (see FIG. 7). The pin 43 is then stuck in the recess by the action of the coil spring 25c and, consequently neither the rotor 25 with the detonator 31 not the ignition needle 30 can reach the ignition position. The piton 36 and shaft 38 with the blocking tooth 42 can not be displaced even with an excessive water pressure, due to this engagement of pin 43 in the blind recess 51, and the ignition needle remains blocked. Therefore the water pressure safety arrangement can not be released subsequent to the accidental release of the shear force safety device.

The rotor collar 47 has, in addition to the afore-mentioned transverse recesses 48–50, an arcuately shaped recess 52 into which a blocking pin 53 is adapted to extend. The arcuate recess 52 permits a 90° movement of the rotor 25 on its way to the trigger position. The blocking pin 53 has the task to retain the rotor 25 as soon as the ignition position for the detonator 31 has been reached.

Although the invention is illustrated and described with reference to a single preferred embodiment thereof, it is to be expressly understood that it is in no way limited to the disclosure of such a preferred embodiment, but is capable of numerous modifications within the scope of the appended claims.

What is claimed is:

1. A submergible ignition device for a submarine explosive cable cutter, adapted to cut the anchoring chains and steel cables of sea mines by detonating an explosive charge, comprising in combination, a housing;

a detonator operatively mounted in the housing;

a shearing force safety means operatively mounted in said housing;

a cotter pin safety means operatively connected to said shearing force safety means and adapted to release said shearing force safety means when a predetermined external force has been applied to said cotter pin safety means;

a water pressure safety means operatively mounted in said housing;

a blocking rotor means rotatably mounted in said housing;

an ignition needle blocking means operatively mounted in said housing; and a dummy position setting means operatively mounted in said housing;

all of the aforesaid means being adapted to move from an unblocking to a blocking position and being operatively connected to each other or coacting with each other so that said detonator can only be triggered after all said means have been positively moved to their respective unblocking positions.

2. The submergible ignition device for a submarine explosive cable cutter as set forth in claim 1, wherein said shearing force safety means compises a driver rod, said housing having a first bore, said driver rod being slidably movable in said first bore, a pressure plate fixed to said driver rod and adapted to contact submerged chains or steel cables, a shear plate mounted in said housing, said shear plate being adapted to be sheared by said driver rod when a predetermined force is applied to said pressure plate.

3. The submergible ignition device for a submarine explosive cable cutter as set forth in claim 2, wherein said driver rod has a first longitudinal recess, a first pin operatively mounted in said housing and adapted to project into said first recess, said first pin coacting with said driver rod so that its slidable movement in said first bore is substantially linear and non-rotatable, said driver rod having a second recess, a spring-biased first safety bolt movably mounted in said housing between a blocking and an unblocking position, whereby when said driver rod has punched through said shear plate one end of said first safety bolt being adapted to move into said second recess of said driver bolt.

4. The submergible ignition device for a submarine explosive cable cutter as set forth in claim 3, wherein said blocking rotor means inlude a rotor rotatably mounted in said housing, whereby when said first safety bolt is in said blocking position the other end thereof contacts said rotor and thereby blocks its rotary movement until said first safety bolt moves to its unblocking position.

5. The sumbergible ignition device for a submarine explosive cable cutter as set forth in claim 4, including a first locking pin transversely movably mounted in said housing relative to the movement of said first safety bolt, a spring-biased blocking bolt parallelly movably mounted in said housing relative to said first safety bolt from a blocking to an unblocking position, and a spring-biased pressure bolt perpendicularly movably mounted in said housing relative to the movement of said blocking bolt from an inoperative to an operative position and adapted to contact and coact with said rotor, whereby when said first safety bolt has moved into its unblocking position, said locking pin thereafter moves towards said first safety bolt thereby releasing said blocking bolt which thereafter moves to an unblocking position thereby releasing said pressure bolt which thereafter contacts and rotates said rotor in said housing.

6. The submergible ignition device for a submarine explosive cable cutter as set forth in claim 5, a second locking pin transversely movably mounted in said housing relative to the movement of said spring-biased blocking bolt, a spring-biased ignition needle transversely movably mounted in said housing relative to said second locking pin and towards said rotor, whereby after said pressure bolt has reached its operative position said second locking pin is adapted to move towards said pressure bolt thereby releasing said ignition needle to move towards said rotor.

7. The submergible ignition device for a submarine explosive cable cutter as set forth in claim 6, wherein said water pressure safety means comprises a spring-biased piston, said housing having a second bore, said piston being movably mounted in said second bore, a rubber membrane mounted in said bore and hermetically sealing it and coacting with said piston, said housing includes an air filled compensating chamber which is in fluid communication with said second bore and one side of said rubber membrane, the other side of said rubber member being adapted to be subjected to the pressure of the ambient water in which said ignition device is submerged, a blocking slide affixed to said piston, said slide having a first projection which forms part of the dummy projection setting means operatively coacting with said rotor and adapted to unblock the rotary movement of said rotor when said rubber membrane is subjected to a predetermined pressure, said slide having a second projection adapted to block the movement of said ignition needle towards said rotor when said rubber membrane is subjected to a predetermined pressure.

8. The submergible ignition device for a submarine explosive cable cutter as set forth in claim 7, wherein said blocking slide has a first recess through which said ignition needle may be projected when said piston is moved by pressure exerted on said rubber membrane to a position corresponding to a predetermined water pressure.

9. The submergible ignition device for a submarine explosive cable cutter as set forth in claim 8, wherein said rotor has first, second and third recesses, said first projection of said slide being adapted to move from said first recess into said second recess of said rotor when said rubber membrane is subjected to predetermined pressure, whereby said rotor is adapted to rotatably move into an ignition position after said first safety bolt has moved into its unblocking position.

10. The submergible ignition device for a submarine explosive cable cutter as set forth in claim 9, wherein said rotor, said first projection being adapted to enter said third recess of said rotor and thereby retain it against rotation, when said shear plate is accidentally sheared by said driver rod before said piston and blocking slide has unblocked the rotary movement of said rotor.

* * * * *